US006994463B1

(12) United States Patent
Lin

(10) Patent No.: US 6,994,463 B1
(45) Date of Patent: Feb. 7, 2006

(54) VERTICALLY COMBINED DOUBLE SOCKETS FOR CHRISTMAS LIGHTS

(76) Inventor: Mei-Lu Lin, P.O. Box 697, Fongyuan City, Taichung County (TW) 420

( * ) Notice: Subject to any disclaimer, the term of this patent is extended or adjusted under 35 U.S.C. 154(b) by 0 days.

(21) Appl. No.: 10/954,167

(22) Filed: Oct. 1, 2004

(51) Int. Cl.
*H01R 33/00* (2006.01)

(52) U.S. Cl. ..... 362/654; 362/252; 362/227; 362/249

(58) Field of Classification Search ..... 362/654, 362/653, 227, 249, 252, 644, 647, 652, 806; 439/648, 665
See application file for complete search history.

(56) References Cited

U.S. PATENT DOCUMENTS 1,642,626 A * 9/1927 Paiste ..... 439/648
6,382,813 B1 * 5/2002 Huang ..... 362/249
6,478,455 B2 * 11/2002 Ahroni ..... 362/352

* cited by examiner

*Primary Examiner*—Renee Luebke
*Assistant Examiner*—David Makiya

(57) ABSTRACT

A vertically combined sockets for Christmas lights includes an upper and lower tubular sockets connected together on their lower and upper bottoms. The upper tubular socket has a pair of retaining grooves, a first contact plate groove and a concaved groove in inner peripheries perpendicular to each other for respectively engaging a first contact plate of a first electric wire, a pair of insertion plates and an elongate copper plate having a common contact plate therein from the lower tubular socket. A combination slot butting an introverted free end, a protrusion at the bottom of each of the tubular sockets engaged with one another, a second contact plate groove in the lower tubular socket for disposing a second contact plate of a second electric wire, a pair of hooks on opposing outer peripheries of the upper tubular socket for respectively holding the first and second electric wires after they extended out of the combination slots and a pair of lamps respectively pressed into the upper and the lower rims of the tubular sockets.

5 Claims, 7 Drawing Sheets

VERTICALLY COMBINED DOUBLE SOCKETS FOR CHRISTMAS LIGHTS

BACKGROUND OF THE INVENTION

The present invention relates to structure of Christmas lights and more particularly to a vertically combined double sockets for Christmas lights which is easy to make shape and readily to assemble especially that the assembly of the finished products are proved stable.

Most the prior art double sockets are made by integral injection. Due to that their interior contact plates, electric wires as well as the lamps should have to assembled manually into a long and narrow space that causes great inconvenience. So that these types of combined double sockets has to overcome a lot of tech problems. It can not help but costs more. Thus, the combined double sockets available in the market mostly belongs to the juxtaposed type which might be shaped by integral injection of combined with juxtaposed combination with a pair of identical sockets in which the lamps are toward similar directions. My previous disclosures are of stepped combination with two, three or four sockets which provide a convenience of the assembly of the parts. But the structure of vertically combined sockets is still not materialized.

SUMMARY OF THE PRESENT INVENTION

The present invention has a main object to provide a vertically combined double sockets for Christmas lights in which the contacts and the electric wire are easily to assembly, the mold is readily to make so as to save the time of combination and the combination of the parts is stable.

Accordingly, the vertically combined double sockets for Christmas lights of the present invention comprise generally a pair of corresponding upper and lower tubular sockets. The upper socket has a concaved groove, a contact plate groove and at least an insertion groove in the inner periphery, a at least a combination groove and a protrusion in the bottom and a lamp pressed into the upper rim, whereas the lower socket has a contact plate groove in an inner periphery, a protrudent copper plate and at least an insertion plate around the inner periphery abutting the upper rim. The copper plate is functioned to positioning a common contact plate and a protrusion and at least a concaved inlaid groove in the top. A lamp pressed into the lower rim thereof. The contact plate grooves in the inner periphery of the upper and lower sockets respectively secured a contact plate from a pair of electric wires. The copper plate of the lower socket engages into the concaved groove of the upper socket to facilitate the common contact plate extended into the upper socket. So that the lead-in wires of the lamps can be respectively engaged with the single contact plates and the common contact plate to get the power source. Further, the insertion plate and the protrusion of the lower socket respectively engage with the combination groove and the protrusion of the upper socket. At the same time, a protrusion and a combination groove of the upper socket are also engage with the concaved inlaid groove and a protrusion of the lower socket. So that the easy manufacture and the readily and stable are achieved. Besides, the upper socket may be made into double headed.

The present invention will become more fully understood by reference to the following detailed description thereof when read in conjunction with the attached drawings.

DETAILED DESCRIPTION OF THE PREFERRED EMBODIMENT

Figure 1:
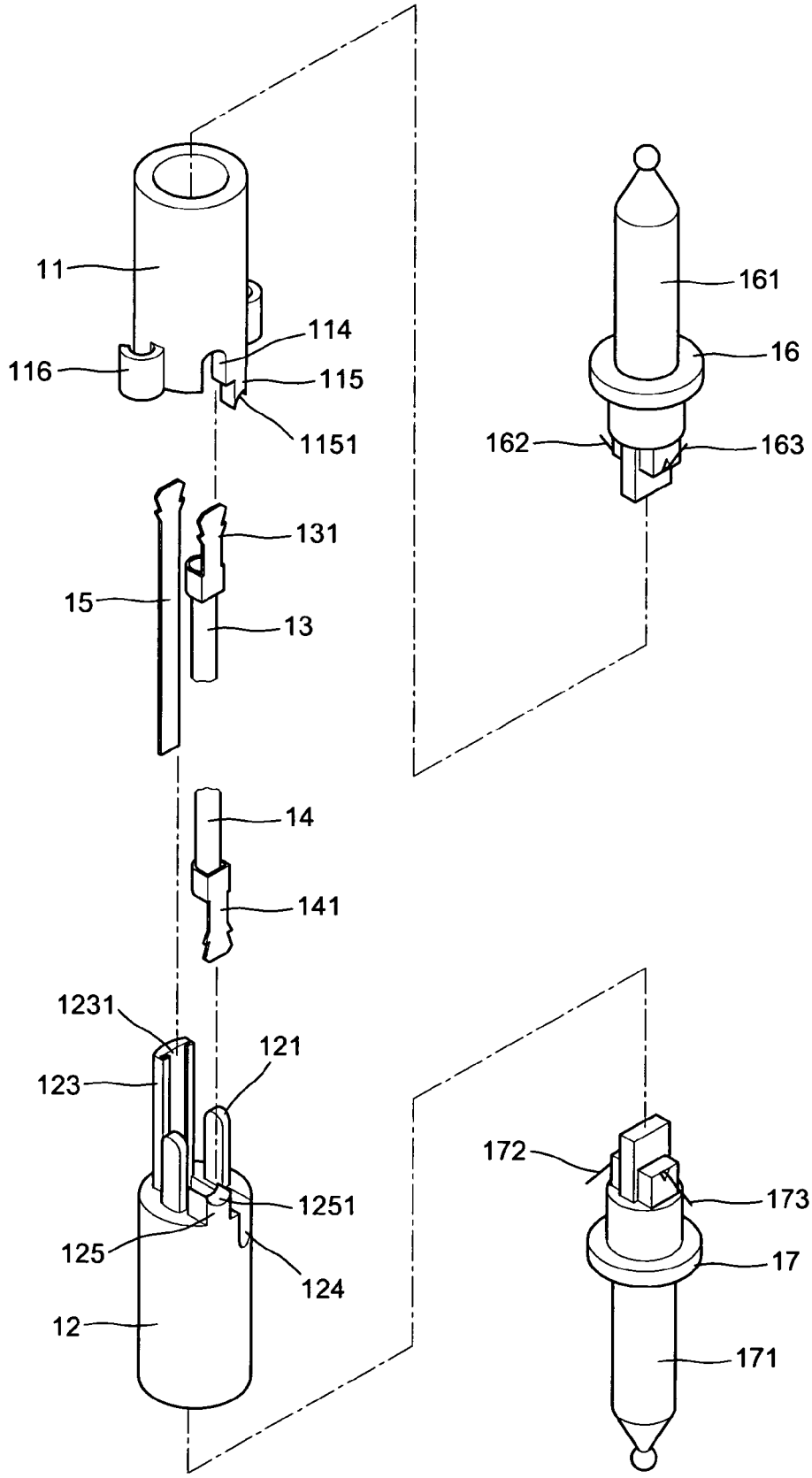
FIG. 1 is an exploded perspective view of a preferred embodiment of the vertical combined sockets of the present invention.
Figure 2:
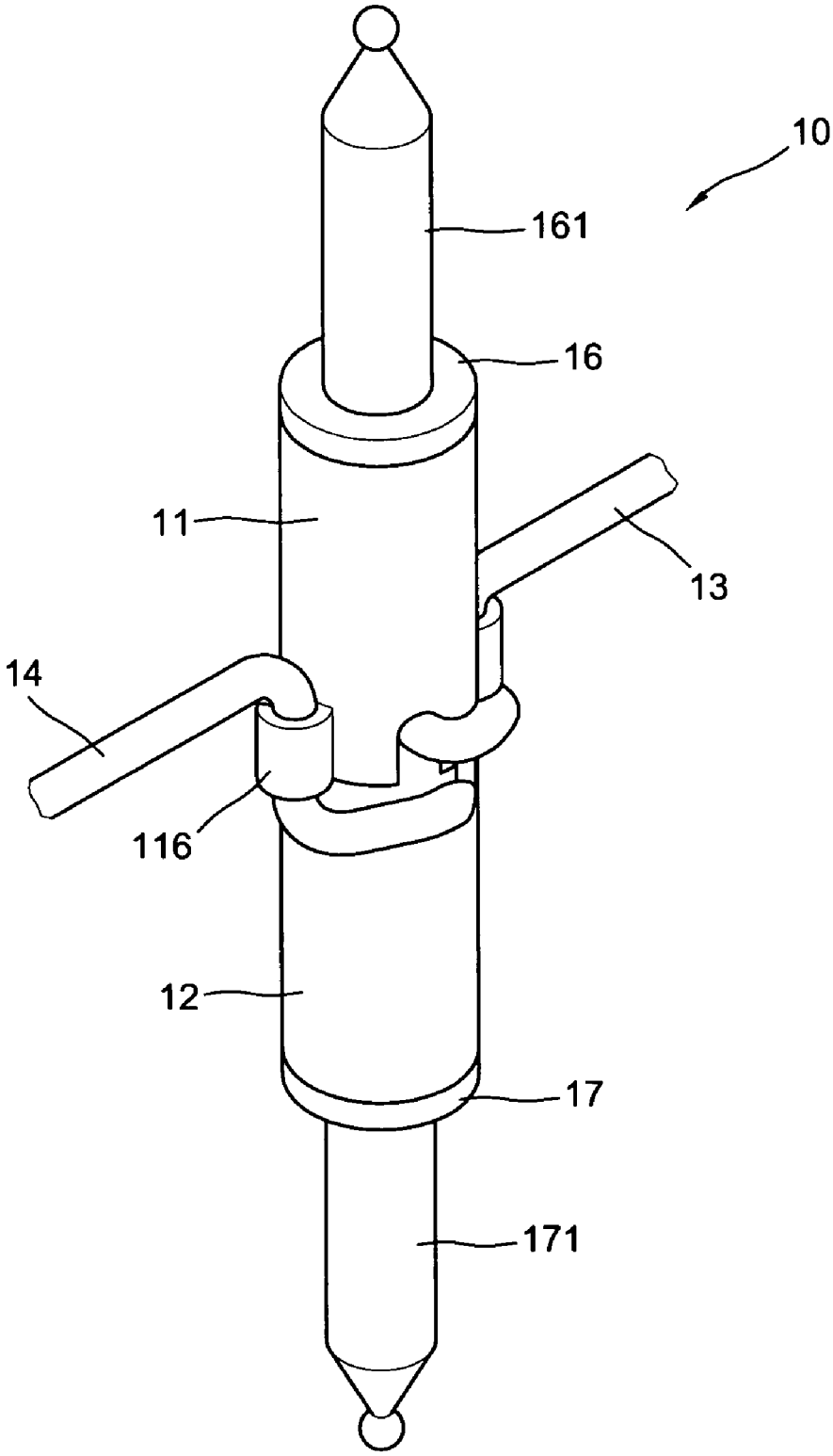
FIG. 2 is a perspective view to show the assembly of FIG. 1.
Figure 3:
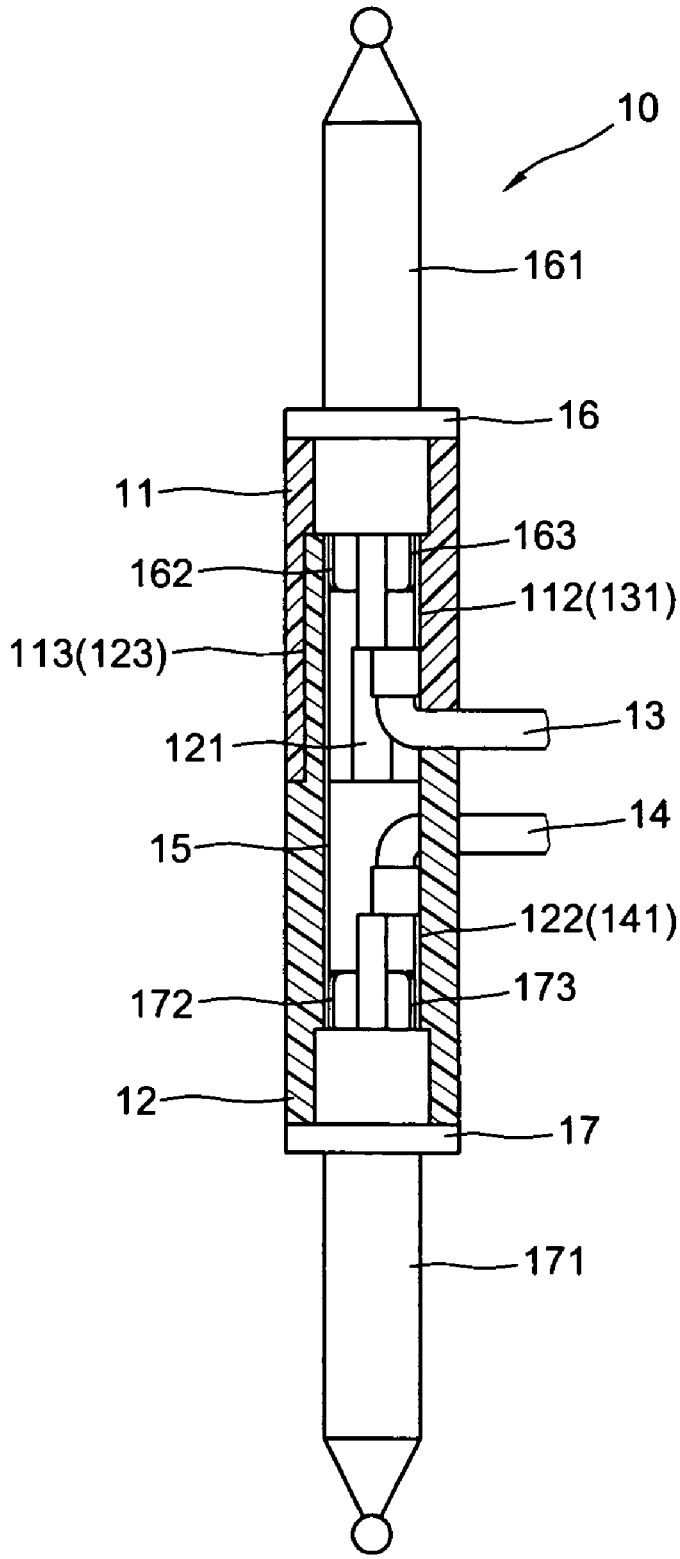
FIG. 3 is a longitudinal sectional view of FIG. 2.
Figure 4:
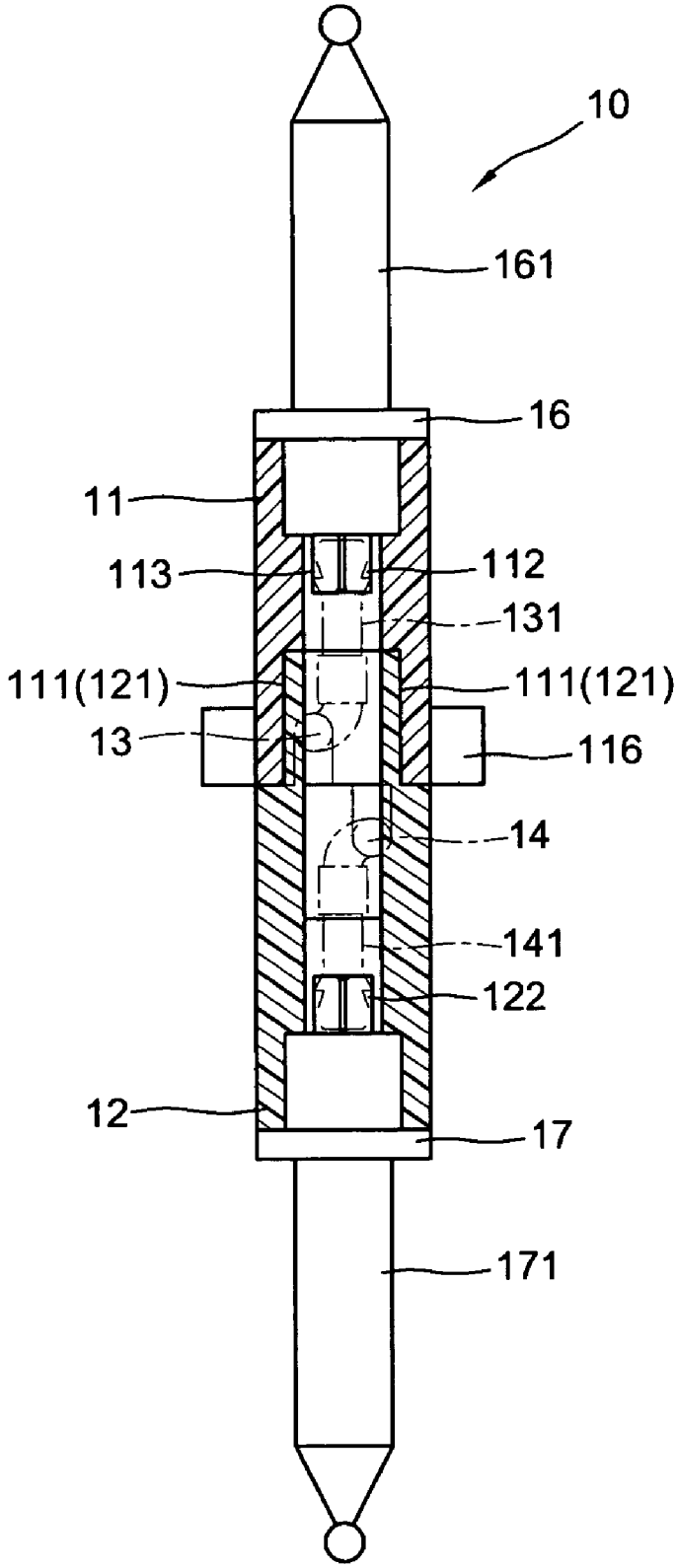
FIG. 4 is another longitudinal sectional view of FIG. 2.
Figure 5:
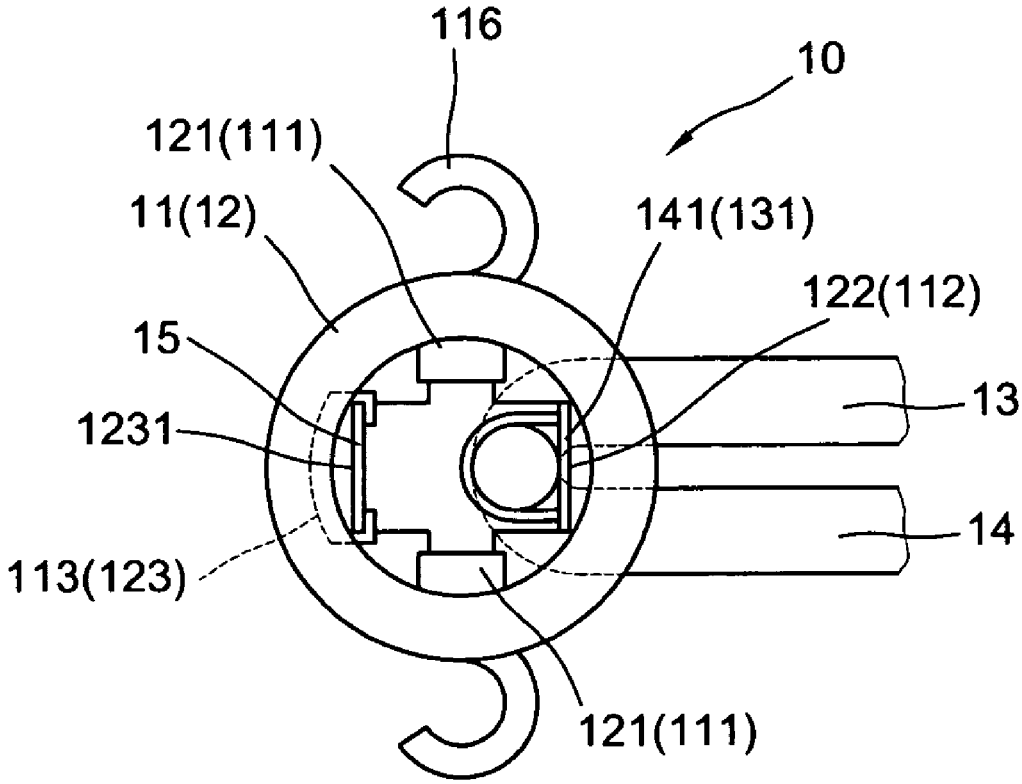
FIG. 5 is a top plane view of FIG. 2.

With reference to the drawings and initialed from FIGS. 1 to 5, the vertically combined double sockets for Christmas lights of the present invention 10 comprises an upper and a lower tubular sockets 11 and 12 combined together with their lower and upper bottoms. The upper tubular sockets 11 has a pair of retaining grooves 111, a first contact plate groove 112 and a concaved groove 113 in the predetermined positions of the inner peripheries perpendicular to each other, a first combination slot 114 abutting a first protrusion 115 which includes an introverted end 1151 in free end at the bottom and a pair of hooks 116 on the opposing outer peripheries abutting the bottom thereof. The length of the protrusion 115 is shorter than the depth of the combination slot 114. The lower tubular socket 12 has the upper bottom combined with the lower bottom of the upper tubular socket 11, a pair of insertion plates 121 projected upward from the opposing upper bottom engaged with the retaining grooves 111, a second contact plate groove 122 in an inner periphery, an elongate copper plate 123 in an inner periphery and projected upward from the upper bottom perpendicular to the insertion plates 121 and engaged within the concaved groove 113 of the upper tubular socket 11, a second combination slot 124 abutting a second protrusion 125 which includes an introverted free end 1251 at the upper bottom opposite to the elongate copper plate 123 respectively engaged with first protrusion 115 and the first combination slot 114. The elongate copper plate 123 has a longitudinal guide 1231 in inner side for positioning a common contact plate 15 therein. A first single contact plate 131 from a first electric wire 13 secures to the contact plate groove 112 and the electric wire 13 extends out of the first combination slot 114 of the upper tubular socket 11 and held by one of the hooks 116 after bent for two bends. A second single contact plate 141 from a second electric wire secures to the contact plate groove 122 of the lower tubular socket 12 and the electric wire 14 extends out of the second combination slot 124 and is held by another hook 116 after bent for two bends, too.

A first lamp 16 is pressed into the upper rim of the upper tubular socket 11 and has a bulb 161 in a base and a pair of lead-in wires 162 and 163 attached to the lateral sides of the base respectively engaged with the common contact plate 15 and the first single contact plate 131, and a second lamp 17 is pressed into the lower rim of the lower tubular socket 12 and has a bulb 171 in a base and a pair of lead-in wires 172 and 173 attached to the lateral side of the base respectively engaged with the common contact plate 15 and the second single contact plate 141 in the lower tubular socket 12.

The upper and lower sockets 11 and 12 are separately molded and their length are shorter than the prior art sockets. So that their molds are easy to make and the product is easy to manufacture which facilitates manual assembly. The difficulty of a single tubular socket engaged with a pair of lamp is also overcame.

Figure 6:
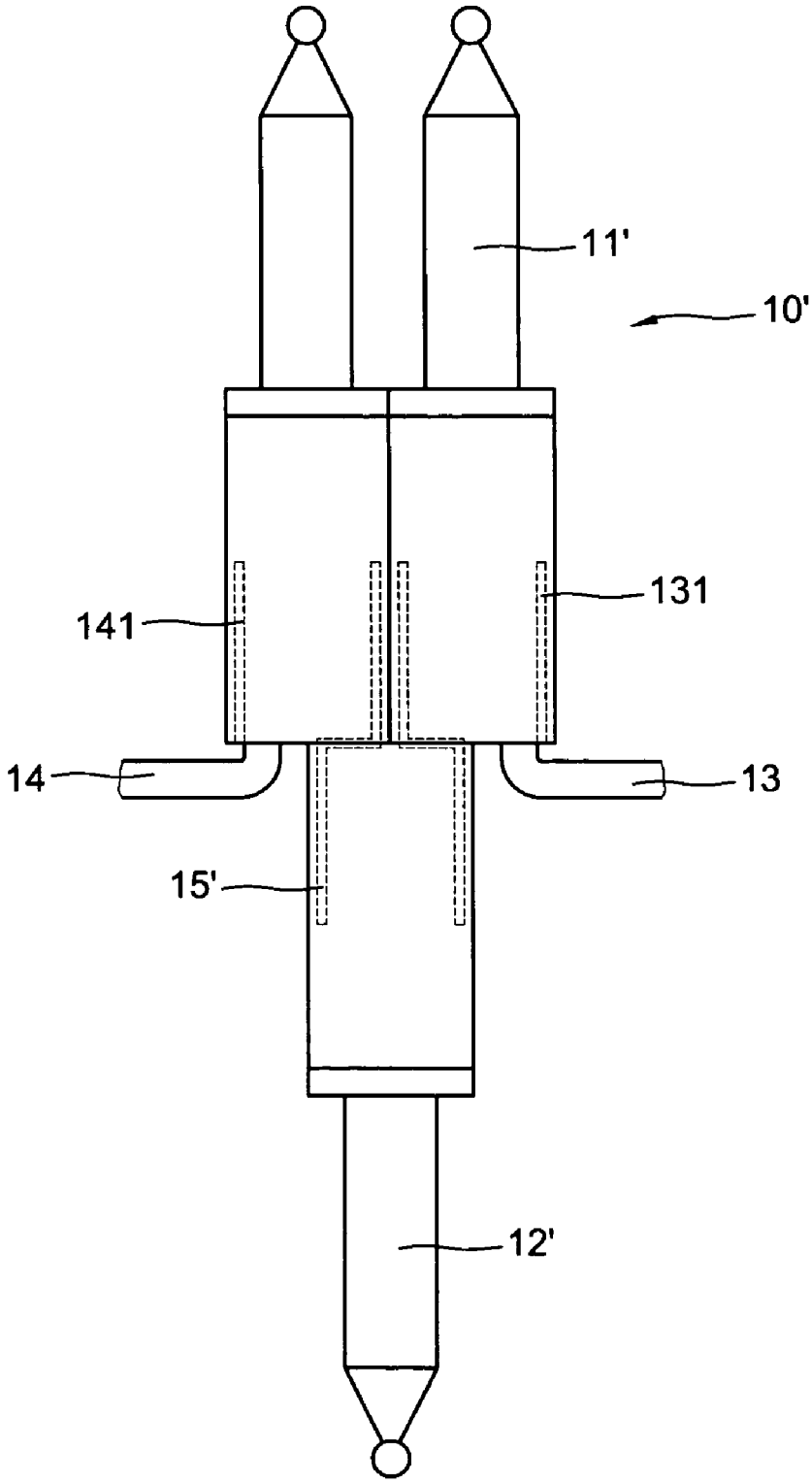
FIG. 6 is a an alternate arrangement of the present invention.

FIG. 6 shows an alternate arrangement of the vertically combined sockets 10' of the present invention which comprises a combined double upper tubular socket 11' connected on their bottoms with single lower tubular socket 12' each having a lamp. The double tubular upper sockets each has a single contact plate 131 and 141 from a pair of electric wires 13 and 14 in inner periphery and a bent common contact plate 15' in an inner periphery opposite to the single contact plates 131 and 141 and extended into the lower tubular socket 12'. The connecting elements of the tubular sockets 11' and 12' are similar to the above embodiment mostly.

Figure 7:
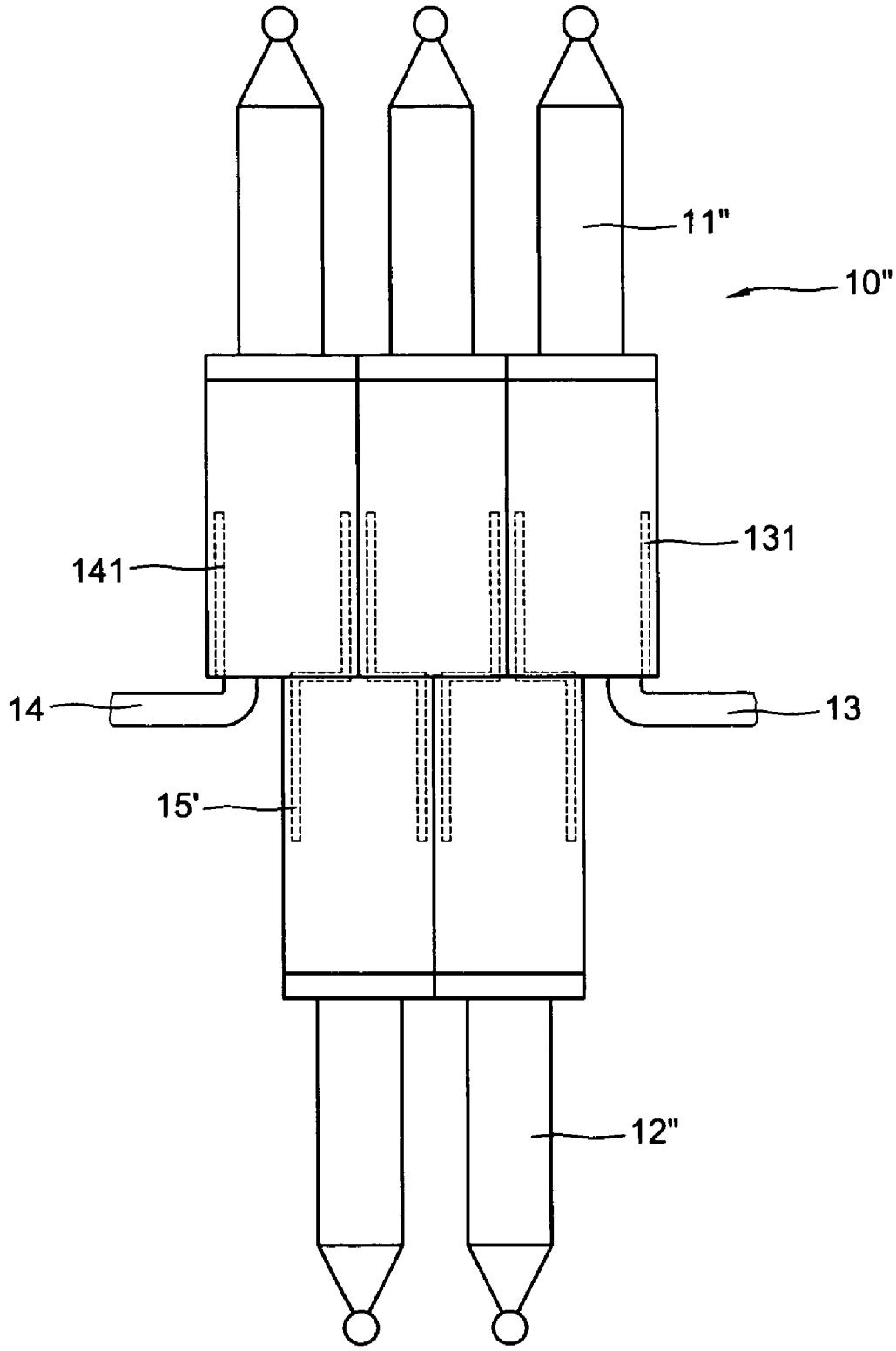
FIG. 7 is another alternate arrangement of the present invention.

FIG. 7 shows another alternate armament arrangement of the vertically combined socket 10" of the present invention which comprises a combined triple upper tubular sockets 11" connected on their bottoms with a combined double lower tubular sockets 12". A pair of single contact plates 131 and 141 from a pair of electric wires 13 and 14 in a inner periphery of the two outmost sockets of the triple upper tubular socket 11", and a bent common contact plate 15' in the opposite inner periphery facing to the single contact plates 131 and 141 and respectively extended into the double lower tubular sockets 12". A pair of the bent common contact plates 15' in the opposite inner peripheries of the central socket of the double lower tubular socket 12" respectively. The sockets each has a lamp pressed into their upper and lower rims and the connecting elements on their bottoms are also similar to the above embodiment.

Note that the specification relating to the above embodiment should be construed as an exemplary rather than as a limitative of the present invention, with many variations and modifications being readily attainable by a person of average skill in the art without departing from the spirit or scope thereof as defined by the appended claims and their legal equivalents.

I claim:

1. Vertically combined double sockets for Christmas lights comprising:

an upper tubular socket with a lower bottom and a lower tubular sockets with an up bottom where said tubular sockets are connected at said upper and lower bottoms and each has an upper and lower rim, said upper tubular socket having a pair of retaining grooves, a first contact plate groove and a concaved groove in predetermined positions of inner peripheries perpendicular to each other, a first combination slot abutting a first protrusion which includes an introverted free end at the bottom thereof and a pair of hooks on opposing outer peripheries abutting the bottom, said lower tubular socket having a pair of insertion plates projected upward from opposing upper bottom engaged within the retaining grooves of said upper tubular socket, an elongate copper plate in an inner periphery perpendicular to the insertion plates and projected upward above the upper bottom engaged within the concaved groove of said upper tubular socket and having a longitudinal guide in inner side for disposing a common contact plate therein, a second combination slot abutting a second protrusion which includes an introverted free end positioned at the upper bottom opposite to the elongate copper plate and respectively engaged with the first protrusion and the first combination slot of said upper tubular socket and a second contact plate groove in an inner periphery opposite to the elongate copper plate, a first single contact plate from a first electric wire engaged with the contact plate groove of said upper tubular socket and a second single contact plate from a second electric wire engaged within the second contact plate groove of said lower tubular socket, wherein said first and second electric wires are respectively extended out of said combination slots and held by said hooks;

a first lamp pressed into the upper rim of said upper tubular socket having base, a bulb in the base and pair of lead-in wires attached to opposing lateral outer surfaces of the base respectively engaged with said common contact plate and said first single contact plate;

a second lamp pressed into the lower rim of said lower tubular socket having a base, a bulb in the base and a pair of lead-in wires attached to opposing lateral outer surfaces of the base respectively engaged with said common contact plate and said second single contact plate.

2. The vertically combined double sockets as recited in claim 1, wherein said upper and lower tubular sockets have a short length.

3. The vertically combined double sockets as recited in claim 1, wherein said protrusions have a length shorter than said combination slots.

4. The vertically combined double sockets as recited in claim 1, wherein said upper tubular socket may be doubled up.

5. The vertically combined double sockets as recited in claim 1, wherein said upper tubular socket may be tripled and said lower tubular socket may be doubled up.

* * * * *